United States Patent [19]

Tatom, Jr.

[11] Patent Number: 4,613,801

[45] Date of Patent: Sep. 23, 1986

[54] TROLLING MOTOR FOOT CONTROL WITH ARC SUPPRESSOR

[76] Inventor: Mabry Tatom, Jr., Box 282, Sweetwater, Tex. 79556

[21] Appl. No.: 631,320

[22] Filed: Jul. 16, 1984

[51] Int. Cl.[4] ..... H01H 9/30

[52] U.S. Cl. ..... 318/440; 361/2; 361/13

[58] Field of Search ..... 440/6, 7; 114/255; 361/2, 8, 9, 13; 318/440

[56] References Cited

U.S. PATENT DOCUMENTS

| | | | |
|---|---|---|---|
| 3,881,443 | 5/1975 | Hamp | 440/6 X |
| 4,066,032 | 1/1978 | Travis | 440/6 |
| 4,114,074 | 9/1978 | Stewart et al. | 318/257 |
| 4,360,766 | 11/1982 | Bogardus, Jr. | 318/440 X |
| 4,406,630 | 9/1983 | Wood, Jr. | 440/6 |

FOREIGN PATENT DOCUMENTS

| | | | |
|---|---|---|---|
| 0511538 | 2/1938 | United Kingdom | 361/13 |

*Primary Examiner*—William M. Shoop, Jr.
*Assistant Examiner*—Bentsu Ro
*Attorney, Agent, or Firm*—Wendell Coffee

[57] ABSTRACT

A trolling motor on a bass boat is connected to batteries by closing a relay switch. Arcing at the switch contacts is suppressed by two capacitors, in series, nonpolarized relation, shunted across the relay switch. The relay coil is actuated to close the relay switch when a push button-type spring loaded control switch or a parallel connected toggle type control switch is closed. The two control switches are mounted on a somewhat flat control box for easy shoe clad foot operation. The wires from the control box are of sufficient length that the box may be placed at any convenient location on the boat. The trolling motor batteries may be charged without closing the control box switches.

4 Claims, 4 Drawing Figures

TROLLING MOTOR FOOT CONTROL WITH ARC SUPPRESSOR

BACKGROUND OF THE INVENTION:

(1) Field of the Invention

This invention relates to electrical control circuits for DC motors, and particularly to such controls on boats having DC powered trolling motors.

(2) Description of the Prior Art

Opening and closing switches under DC loads often results in arcing across the switch contacts, particularly with the inductive DC loads produced by DC powered motors. Many control circuits for DC motors use relay switches. The arcing across the contacts of the relay switch causes premature switch failure and degraded operation of the motor.

The electrical control circuit for starting and stopping a DC powered trolling motor on a bass boat is one commercial application where arcs may occur at switches. When a switch is opened or closed to start or stop the trolling motor, the inductive loads produced may be as high as 40 amps across double switch contacts connected in parallel. Arcing across the contacts may result in switch failure, or ignition of the gasoline fumes sometimes present in bass boats.

Another problem associated with the motor control circuits of trolling motors is the common practice before my invention of fixing a spring loaded momentary contact type switch to the bow of the boat as the control switch to activate the relay coil, close the relay switches, and start the motor. The fisherman must interrupt his fishing activities, move to the bow of the boat where the switch is, and remain, while holding the switch button down as long as he wants to operate the trolling motor. Additionally, many systems require a weight to be placed on the push button switch to complete a circuit to the batteries for charging.

Prior to filing this application, a search was conducted in the U.S. Patent and Trademark Office. That search developed the references listed below.

| | |
|---|---|
| U.S. Pat. No. | |
| WALKER | 2,637,769 |
| HARRIS | 2,877,733 |
| MARLEY | 3,196,638 |
| REE | 3,376,467 |
| OSWALD | 3,739,192 |
| GUARASCI ET AL | 3,751,719 |
| ROLLER ET AL | 3,889,625 |
| RHORER ET AL | 4,130,079 |
| GILBERTSON | 4,250,358 |
| Great Britain Patents | |
| LUTZ | 1,433,938 |

Applicant does not regard these references as particularly pertinent D to his invention. They are cited herein in the event that the Examiner might determine that they are pertinent and relevant to the examination of this application. However, these references are examples of the prior art. WALKER, MARLEY, REE, OSWALD, GUARASCI ET AL, and LUTZ disclose arc suppression circuits. ROLLER ET AL, RHORER ET AL, HARRIS, and GILBERTSON disclose marine engine or trolling motor control circuits.

SUMMARY OF THE INVENTION (1) New Function and Surprising Results

I have solved the arc suppression and control switch problems described above. I use a pair of capacitors shunted across a switch under an inductive DC load for arc suppression. The two capacitors are in series, nonpolarized relation. Connected across the relay in this manner, the capacitors effectively suppress arcing that would normally occur when the switch is opened or closed.

Those skilled in the art will understand that my invention has general applicability to arc suppression for switches in circuits under DC loads or inductive loads. I have particularly applied my invention at this time to trolling motor control circuits.

A typical trolling motor is connected to 12-volt DC batteries. When a relay coil is actuated, the relay switches close to delectrically connect the batteries and the motor. I suppress the arc that would normally occur at the relay switch contacts with two capacitors in series, nonpolarized relation shunted across the relay switch. And are suppression circuit according to my invention typically uses relatively inexpensive, durable, and easily replaced capacitors when compared with the components and devices used in other prior art arc suppression circuits. The values, or type, of the capacitors used for particular circuits depends upon the inductive DC load placed upon the switching contacts at which arcs are to be suppressed.

I also prefer to control the relay switch with a push button-type, spring loaded, normally off contact switch, and a two position toggle-type switch, connected in parallel with the push button switch. These two switches are preferably mounted on a chassis, or control box, that is connected to the boat, at the relay and at an equipment battery, by long wires. The control box is not attached or fixed to the boat at the bow, as in the prior art. The long wire and unattached control box permit a fisherman to position the control box at any convenient location in the boat. I also prefer to mount the switches on the control box so as to permit the placement of the box on the boat floor, and operation of the toggle or push switch with a shoe clad foot, as desired.

Therefore, with my invention installed on the boat, a fisherman may place the control box any where he may be in the boat, and maneuver the boat for short distances by depressing the push switch as desired from his fishing position with his foot, while using both hands to fish. Alternatively, the fisherman could troll the boat continuously by moving the toggle switch to the closed position, and move about the boat or remain in place, as desired, without having to keep his foot on the push button. On a prior art boat employing the common bow mounted control switch, the fisherman would have to move to the bow of the boat, interfering with his fishing activities. If he wanted to troll continuously, he would have to remain at the bow of the boat to hold the push switch down, instead of being able to move about the boat.

A trolling motor control circuit according to my invention may also incorporate other features, such as a diode shunted across the relay coil to protect other equipment that may be connected to the equipment battery from being damaged by inductive transits.

A diode, and a toggle switch in parallel to the diode, shunted across the relay switch permits charging the motor batteries with a charger either having or not having a maintenance free feature, and eliminates the prior practice of weighing down the bow mounted push button.

Thus, it may be seen that the total result and function achieved by my combination of elements greatly exceeds the sum of the functions of the individual elements, such as wires, relays, motors, batteries, switches, etc.

(2) Objects of this Invention

An object of this invention is the suppression of arcs across switches under inductive DC loads.

Another object of this invention is the convenient operation of a trolling motor.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
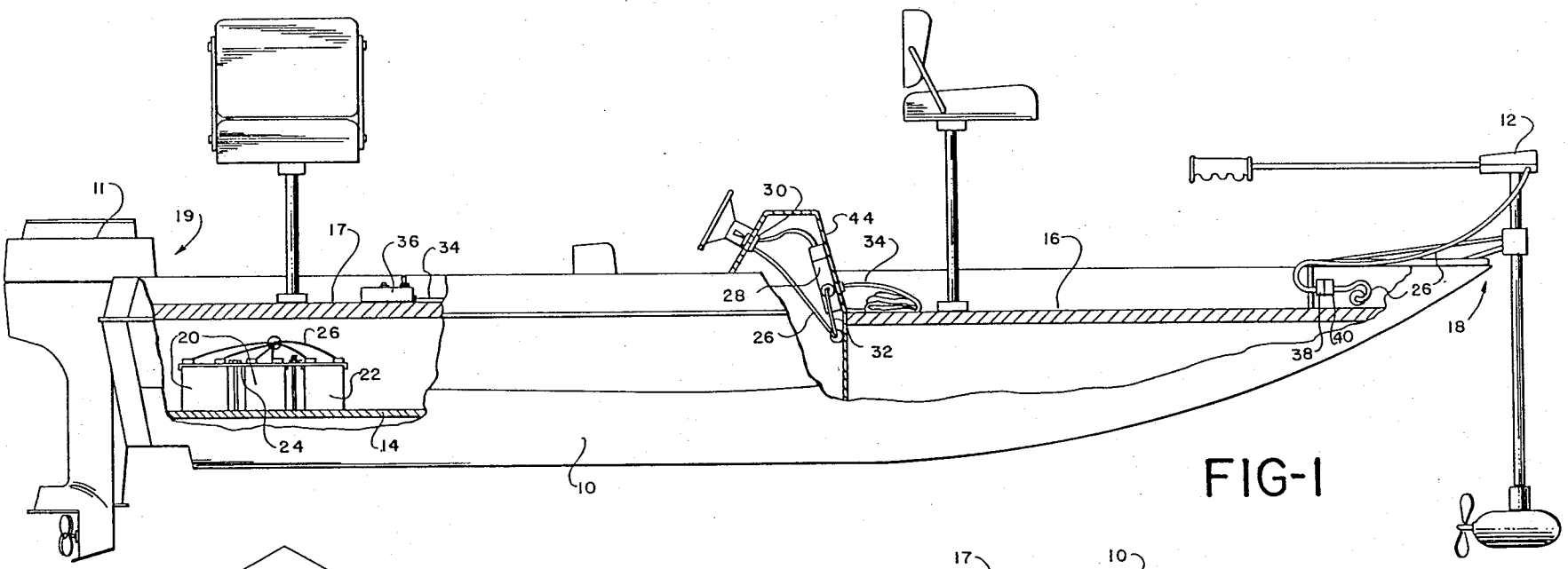
FIG. 1 is a side section view of a bass boat with a trolling motor control according to my invention installed thereon.

FIG. 1 shows a typical bass boat having boat body 10, outboard gasoline motor 11 and trolling motor 12 mounted on the body 10, boat floor 14, and fishing platforms 16 and 17 near bow 18 and stern 19, respectively. The trolling motor 12 is DC powered, and preferably able to run on 12 or 24 volts DC. Motor batteries 20 and equipment battery 22 are mounted in battery holders 24 in the boat body 10 below the platform 17. Each battery 20 or 22 supplies and is a source of 12-volt direct current. The equipment battery 22 is only one form of an equipment power source that could be used on the boat.

Power wires 26 connect the motor batteries 20 and the trolling motor 12, forming a motor electrical circuit. Components in relay box 28, and power selector switch 30, are in the motor circuit. Equipment wire 32 connects the equipment battery 22 and components in the relay box 28. Control box wires 34 connect components in the relay box 28 to control switches on control box 36.

Referring to FIG. 1, male plug 38 and female receptacle 40, in the power wires 26 extending between the power selector switch 30 and the motor 12, form an electrical connector set providing for disconnection of the motor from the motor circuit and connection of charging means for charging the motor batteries 20 in the form of a battery charger (not shown). For this embodiment, the male plug 38 of the motor is disconnected, and a male plug (not shown) of the battery charger is connected to the female receptacle 40 for charging the batteries 20.

Figure 2:
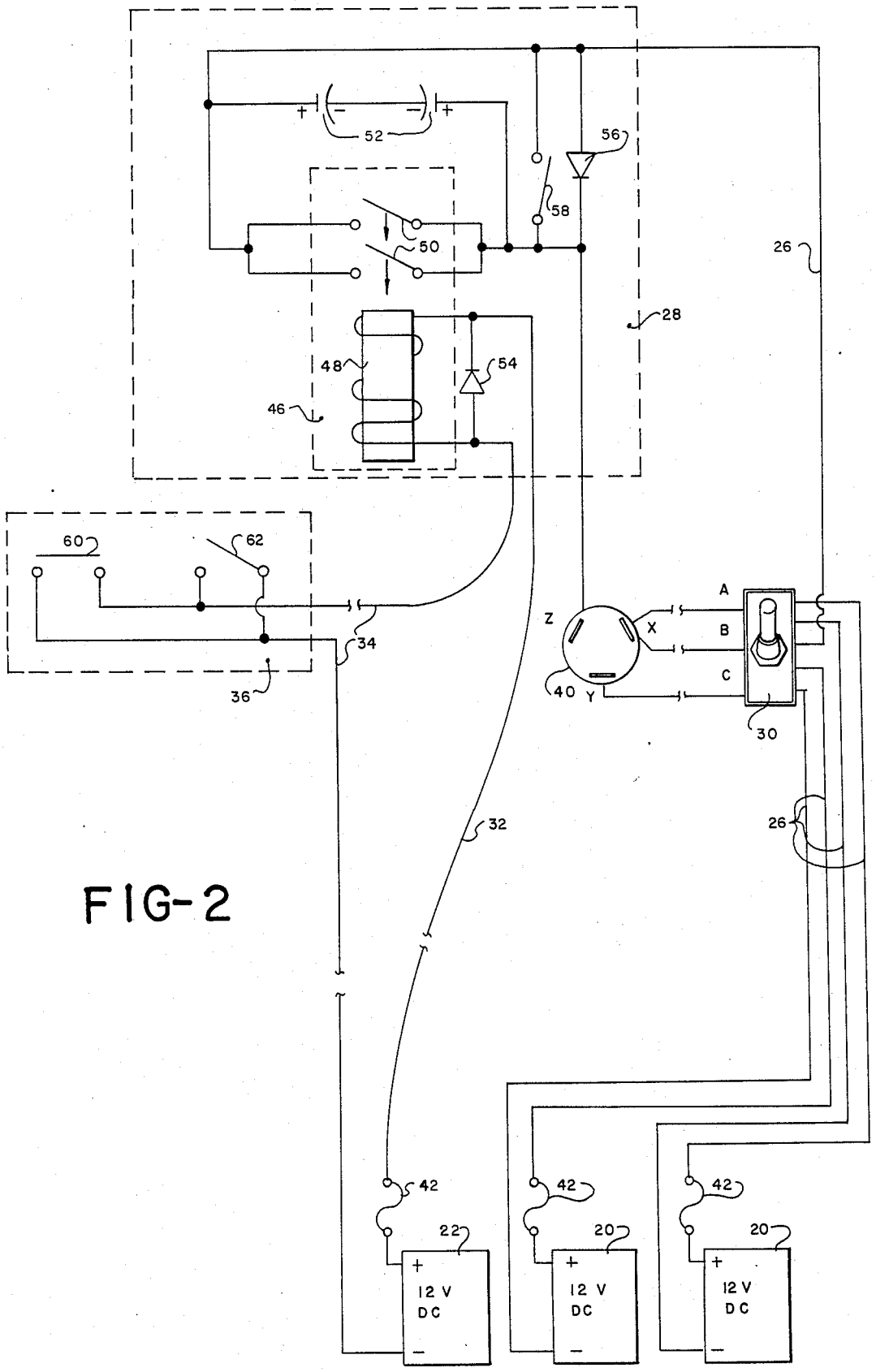
FIG. 2 is a schematic diagram of the electrical circuit of the trolling motor control shown in FIG. 1.

Having described the arrangement and physical location on the boat of various parts of this trolling motor control embodiment of my invention, shown in FIG. 1, attention is now directed to FIG. 2, which schematically diagrams the preferred electrical circuit for this embodiment.

The power wires 26 leading from the motor 12 are connected to three conductors of the female receptacle 40, schematically shown in FIG. 2. The motor is not shown in FIG. 2, it being understood that the three prong plug 38 would be inserted appropriately into the receptacle 40 and engage the appropriate contacts "X", "Y", or "Z" shown in FIG. 2. The motor 12 places a DC load on the motor circuit.

The batteries 20 are typical bass boat power batteries commonly used to provide 12 or 24 volt power to a DC trolling motor. Fuses 42 protect the circuits from shorts and the like. The equipment battery 22 is preferably a typical 12-volt boat cranking battery as is used on bass boats to provide power for equipment other than the trolling motor.

The power selector switch 30, shown as a three position toggle switch, is preferably mounted on console 44 of the boat (FIG. 1). The first position of the switch 30 ("A" in FIG. 2) connects the positive and negative leads from one of the power batteries 20 to the X and Z contacts, respectively, of the female receptacle 40.

The second position of the switch 30, ("B" in FIG. 2), switches the other of the batteries 20 to the contacts X and Z. In the third position ("C" in FIG. 2), the negative and positive leads from the batteries 20 are connected to the switch so that the two power batteries 20 are connected in series to contacts Y and Z. Thus, switch 30 positions "A" and "B" provide 12-volts DC to the motor through contacts X and Z, whereas position "C" provides 24 volts to the trolling motor through the contacts Y and Z.

Relay 46 is mounted in the relay box 28. The area inside the dashed line referenced as "28" in FIG. 2 designates the components in the relay box 28 whereas the area inside the dashed line referenced as "46" designates the relay 46. The relay 46 includes actuation relay coil 48, and relay switches 50 normally open, and closed by the application of current to the coil 48. The switches 50 are connected in parallel as shown in FIG. 2.

The switches 50 are in a portion of the motor circuit connecting the negative contact Z of the receptacle 40 and a negative connection of the power switch 30 and hence, of the batteries 20. The switches 50 are under an inductive DC load in the motor circuit. The battery 20 is connected to the trolling motor through the switches 50.

Capacitors 52 are shunted across, or connected in parallel to, the switches 50. The capacitors 52 are in series and are in nonpolarized relation, as shown by the "+" and "−" signs in FIG. 2. The negative poles of the capacitors 52 are connected in the preferred embodiment, as shown.

In tests using an arc suppression circuit as described according to my invention, the capacitors 52 prevented arcing between the contacts of the relay switches 50 when they were opened and closed under an inductive load such as the DC powered trolling motor 12.

Although described herein in connection only with a trolling motor, based on this disclosure those skilled in the art will recognize that an arc suppression circuit according to my invention also has broad application for arc suppression at switches under inductive DC or other DC loads in industrial or commercial applications. Those skilled in the art will also be able to adapt my invention to other circuits, and to determine the appropriate type and value of components not specified herein.

Other equipment is ordinarily connected to the equipment battery 22. Protective diode 54, shunted across the coil 48 of the relay 46, protects that equipment from damage by any inductive transits from the battery 22.

Charging diode 56, and parallel connected charging switch 58 are shunted across the relay switches 50. The diode 56 and charging switch 58 function to permit the charging of the batteries 20 with a battery charger connected to the female receptacle 40. As shown in FIG. 2, the diode is connected in the circuit in such a manner that a charge or current from the battery charger through the receptacle 40 will turn the diode on, allowing current to go to the batteries for recharging.

If the battery has a maintenance free switch and the switch is in the maintenance free position, the voltage drop across the diode 56 will be eliminated, allowing the batteries to charge. If the charger being employed has no maintenance free position, then the switch 58 is closed to complete the charging circuit.

Of course, when the batteries are not being charged and the trolling motor is connected to the receptacle 40, the charging switch 58 will be in the open position, and the diode 56 will not permit current to shunt across the switches.

The control box wires 34, as shown in FIG. 2, connect the negative lead of the equipment battery 22 to the relay coil 48. The equipment wire 34, as shown in FIG. 2, connects the positive lead of the battery 22 to the coil 48. Together, the equipment and the control box wires form a control electrical circuit electrically connecting the equipment battery and the relay coil. At least one control switch is connected to the control box wires 34. The control switch is opened or closed to disconnect or connect, respectively, the equipment battery and to the relay coil 48. Thus, the control switches form a control device for changing the current supplied to the relay coil 48. For the preferred embodiment shown in the drawings, the preferred control devices or switches are switches 60 and 62 mounted on the control box 36.

Push control switch 60 is preferably a spring loaded, normally open, contact switch that closes when depressed. Toggle control switch 62 is preferably a standard two-position toggle switch with open and closed positions.

Figure 3:
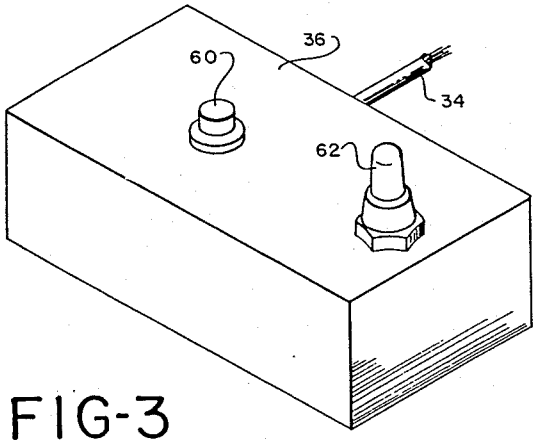
FIG. 3 is a perspective view of the control box shown in FIG. 1.

The control box 36, and the mounting of the control switches 60 and 62 thereon, are shown in detail in FIG. 3. The two switches are separated so that operation of one control switch by a shoe clad foot will not be interferred with by the other control switch. Additionally, the toggle control switch 62 is mounted near an edge of the control box 36 to permit easier operation with a shoe clad foot. The relatively flat shape of the box 36 provides stability as the switches are foot operated.

Figure 4:
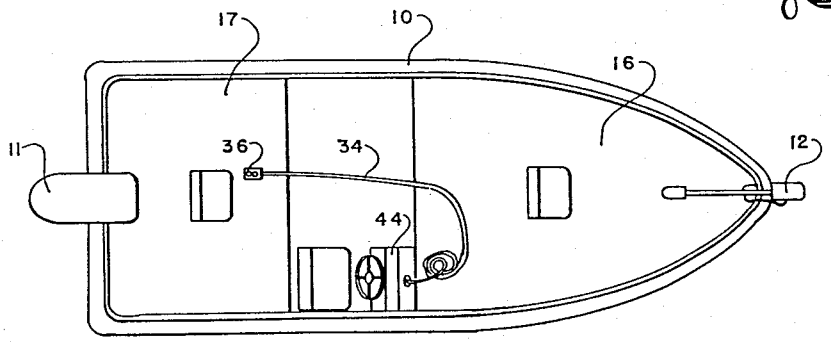
FIG. 4 is a top plan view of the boat shown in FIG. 1.

To permit the positioning of the control switches about the fishing platform as desired, and unlike the prior art, the control box 36 is not affixed to the boat at the bow near the trolling motor, but is instead connected to the relay box 28 and equipment battery 22 by the long control wires 34. It may be seen by reference to the coiled wires 34 and the length of wire 34 leading to the control box 36 in FIG. 4, that the wires 34 have a length sufficient for the control switches and the control box on which they are mounted to be moved, carried, or placed at any desired position on the boat.

Because the environment in which the switches will be operating is a fishing boat where it is wet, I prefer to use waterproof switches, mounted in a waterproof control box 36, and to use wires clad in rubber or plastic waterproof insulation for the control wires 34, thereby making them water resistant. The cladding of the control wires also protects them as they are stepped on and otherwise abused during normal fishing activities.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provide:

| | | | |
|---|---|---|---|
| 10 | boat body | 34 | control wires |
| 11 | outboard gasoline motor | 36 | control box |
| 12 | trolling motor | 38 | male plug |
| 14 | boat floor | 40 | female receptacle |
| 16 | fishing platform | 42 | fuses |
| 17 | fishing platform | 44 | console |
| 18 | bow | 46 | relay |
| 19 | stern | 48 | actuation coil |
| 20 | power batteries | 50 | switches |
| 22 | equipment battery | 52 | capacitors |
| 24 | battery holders | 54 | protective diode |
| 26 | power wires | 56 | charging diode |
| 28 | relay box | 58 | charging switch |
| 30 | power switch | 60 | push switch |
| 32 | equipment wire | 62 | control switch |

I claim as my invention:

1. A boat having a DC powered trolling motor mounted thereon, at least one motor battery on the boat for supplying direct current a motor electrical circuit connecting the motor battery and the motor, wherein the improved trolling motor control system comprises:

a relay having a relay switch in the motor circuit for disconnecting and connecting the motor battery and trolling motor, and a relay actuator coil that opens and closes the relay switch responsive to changes in current supplied to the relay coil, an equipment battery on the boat, a control electrical circuit connecting the equipment battery and the relay coil, at least one control switch in the control circuit for electrically connecting and disconnecting the motor battery and the trolling motor, and at least two capacitors in the motor circuit shunter cross the relay switch, said capacitors being in nonpolarized, series relation, an electrical connector set in the motor circuit providing for disconnection of the motor from the motor circuit end connection of charging means for charging said motor battery, a charging diode shunted across said relay switch, said charging diode being oriented in the motor circuit such that when the relay switch is open, current may pass from said charging source to the batteries, but not from the batteries to the charging means or to the motor when either is connected.

2. The invention as defined in claim 1 with the addition of the following limitations:

a charging switch in the motor circuit electrically connected in parallel to the charging diode, at least two motor batteries, a three position selector switch mounted on the boat and electrically connected in the motor circuit such that when the relay switch is closed and when the selector switch is in a first position, one of the batteries is electrically connected to the motor, when the selector switch is in a second position, another of the batteries is electrically connected to the motor, and when the selector switch is in a third position, both batteries are electrically connected in series to the motor.

3. The invention as defined in claim 2 with the addition of the following limitations:

a control switch being a spring loeded, push button type switch, and another control switch being a toggle-type switch, said control switches being connected in parallel in said control circuit, said control switches being mounted on a cotnrol box, and the switch and control box connected to the equipment battery and relay coil by control box wires of the control circuit having a length sufficient that the control box is moveable to any desired position in said boat, said toggle control switches, being mounted near the edge of a top of the control box and the push control switch being spaced away from the toggle control switch on said control box top.

4. The invention as defined in claim 1 with the addition of the following limitation:

a charging switch in the motor circuit electrically connected in parallel to the charging diode.

* * * * *